United States Patent [19]

Ianetta

[11] 4,071,062

[45] Jan. 31, 1978

[54] ATTACHMENTS FOR GOLF BAGS

[76] Inventor: Henry Robert Ianetta, 832 Pendley Road, Willowick, Ohio 44094

[21] Appl. No.: 701,101

[22] Filed: June 30, 1976

[51] Int. Cl.[2] ..... A63B 55/04

[52] U.S. Cl. ..... 150/1.5 B; 248/96; 248/156

[58] Field of Search ..... 150/1.5 B; 248/96, 156

[56] References Cited

U.S. PATENT DOCUMENTS

| | | | |
|---|---|---|---|
| 1,452,084 | 4/1923 | Luckett | 150/1.5 B |
| 1,849,803 | 3/1932 | Pedersen | 150/1.5 B |
| 2,399,960 | 5/1946 | Turner | 248/156 |
| 2,482,278 | 9/1949 | Koerner | 248/156 |
| 2,564,318 | 8/1951 | Wick | 150/1.5 B |
| 2,613,010 | 10/1952 | Atkinson | 248/156 X |
| 3,593,766 | 7/1971 | Harmon | 150/1.5 B |

*Primary Examiner*—Donald F. Norton
*Attorney, Agent, or Firm*—Isler and Ornstein

[57] ABSTRACT

Attachments for golf bags are provided which are designed to hold a golf bag in an upright position on the ground while a club is being selected from or replaced in the bag by the golfer. The attachments include holders or retainers which are permanently or removably secured to the bottom of the bag, and pegs or pins which are removably secured to the holders, and penetrate the ground for the purpose of thus holding the bag in upright position. The pegs or pins are removed from the holders or retainers when the bag is not being used on the golf course, and is being carried or transported in a car, as in the trunk compartment of the car, whereby damage to the interior of the car by the pegs or pins is avoided.

8 Claims, 8 Drawing Figures

ATTACHMENTS FOR GOLF BAGS

This invention relates, as indicated, to attachments for golf bags, but is directed more particularly for attachments or devices of a nature which enable a golf bag to be positioned in an upright position while selecting a club from the bag.

In Luckett U.S. Pat. No. 1,452,084 and Pedersen U.S. Pat. No. 1,849,803, golf bags are disclosed having prongs or legs secured to the bottoms thereof, and which are adapted to penetrate the ground for the purpose of supporting the bag in an upright position, and enable the golfer to select a club from the bag while in such position.

In the Luckett patent, the bottom of the bag is provided with an integral upright threaded socket and a plate of the same diameter as the bottom of the bag, is secured to the bottom of the bag, as by means of a stud formed integrally with the plate and which is threadedly secured to the socket, the plate being provided with one or more prongs or legs which penetrate the ground.

Such a construction is objectionable for several reasons, including the fact that the bottom of the bag must be formed to provide the socket, and the plate must be formed to provide both the stud and prongs or legs, thereby providing a rather expensive device. Moreover, the device must be removed from the bottom of the bag, in order to prevent the prongs or legs from damaging the interior of the car in which the bag is carried or transported, and such removal would become difficult in the event that the threads of the sockets and stud became rusted or otherwise damaged.

In the Pedersen patent, the attachment or device comprises a bracket having radiating arms extending from a central hub and which arms are secured, as by rivets, to the bottom of the bag. The central hub is centrally bored and the bore tapped, so that a peg or pin having a threaded upper end may be threaded into the tapped bore of the bracket. In order to facilitate installation and assembly of the bracket with the bottom of the bag, a disk is provided which is attached to the bottom of the bag by means of the rivets which secure the bracket to the bottom of the bag.

Such a construction is also objectionable for several reasons, including the fact that the bracket bore must be tapped, and the peg or pin threaded for securement to the tapped bore, thereby providing a rather expensive device. Moreover, the peg or pin must be removed from the bottom of the bag in order to prevent it from damaging the interior of the car in which the bag is carried or transported, and such removal might become difficult in the event that the threads of the tapped bore and the threads of the peg or pin became rusted or otherwise damaged.

The present invention has, as its primary object, the provision of an attachment or device of the character described, which is free from all of the disadvantages of such prior devices, and yet can be attached to the bottom of a golf bag with a minimum of effort, and at relatively low cost.

Another object of the invention is to provide a device of the character described, in which those portions of the device which are threaded, can be easily and quickly removed from the device, and thus maintained free of rusting, while enabling other portions of the device to remain permanently secured to the bag, or removed, in its entirety, from the bag.

A further object of the invention is to provide a device of the character described, having means for enabling the peg or pin to be clamped or secured to the device without the use of threaded connections, and merely by pushing the peg or pin to a pre-selected position.

A still further object of the invention is to provide a device of the character described, having means incorporated therein for facilitating proper positioning or placement of the peg or pin of the device.

A still further object of the invention is to provide a device of the character described, which consists of a minimum number of parts which can be manufactured, assembled and attached to the bag at low costs, and virtually without the aid of tools.

Other objects and advantages of my invention will be apparent during the course of the following description.

In the accompanying drawings forming a part of this specification, and in which like numerals are employed to designate like parts throughout the same, FIG. 1 is a side elevational view of a golf bag embodying a preferred form of the invention;

Figure 1:
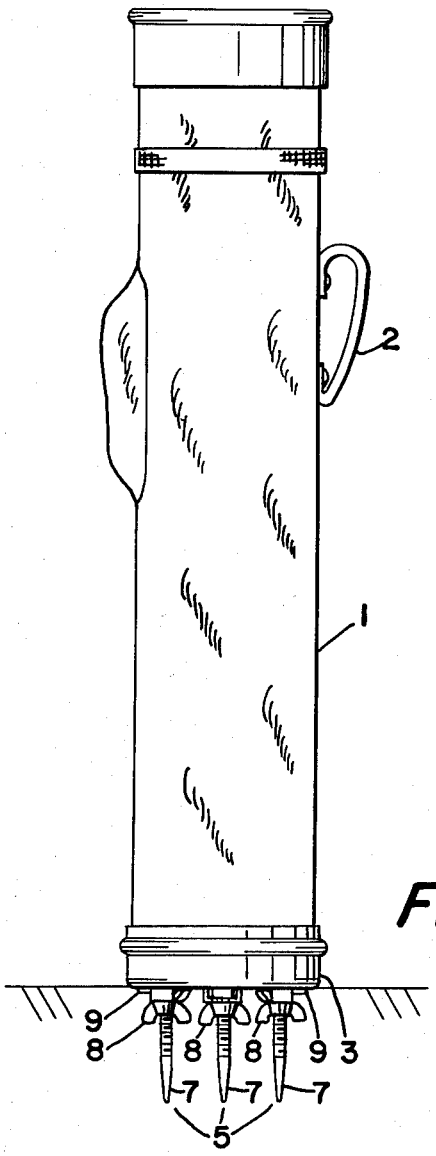
Figure 2:
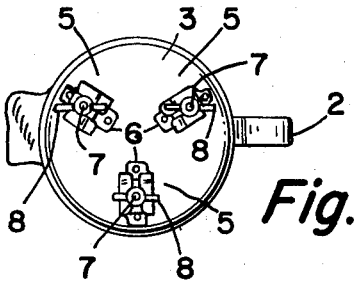
FIG. 2 is a bottom plan view of the bag of FIG. 1.

Referring more particularly to FIGS. 1 to 6 inclusive of the drawings, a conventional type of golf bag is illustrated, comprising an upright substantially cylindrical portion 1 of leather, plastic, fabric or other material, a carrying handle 2 secured to the side of the portion 1, and a molded cup-shaped or cup-like bottom 3, which is permanently secured, in any desired manner, to the lower end of the portion 1, and which may be made of leather, plastic or like material, and of a rigid or semi-rigid character.

Secured to the bottom 3, as by rivets 4, are a plurality of ground-engaging or ground-penetrating members, designated generally by reference numeral 5.

Each ground-engaging or ground-penetrating member 5 comprises a holder element 6, a peg or pin 7, and a wing nut 8.

Figure 5:
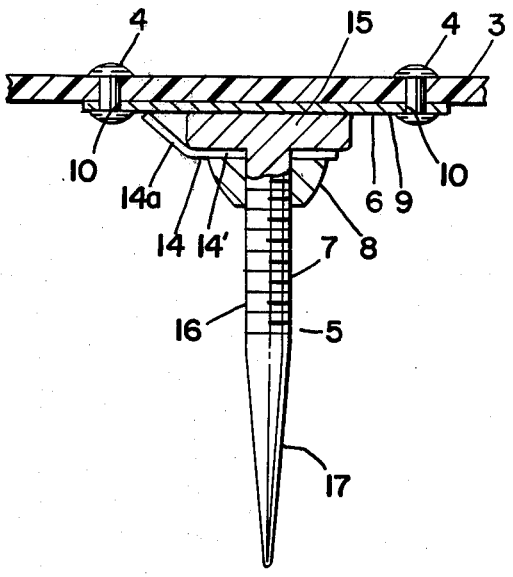
FIG. 5 is a fragmentary cross-sectional view, taken on the line 5—5 of FIG. 3.
Figure 6:
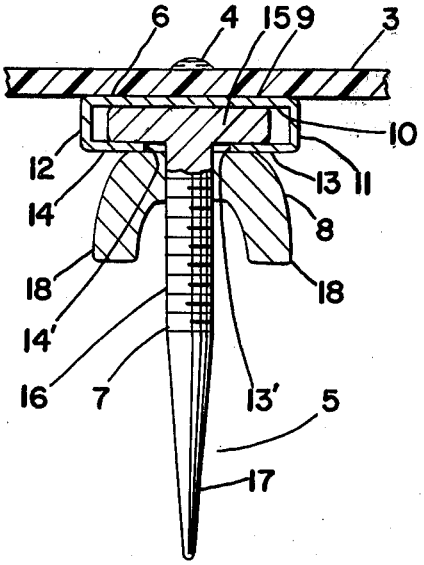
FIG. 6 is a fragmentary cross-sectional view, taken on the line 6—6 of FIG. 3.

The holder element 6 is preferably formed or made of sheet metal or the like, bent to provide an elongated base plate 9, having holes 10 (FIG. 5) adjacent the ends thereof, downturned flanges 11 and 12, which are substantially parallel with each other and which terminate in inturned flanges 13 and 14, which are parallel with the base plate 9, as best seen in FIG. 6.

Figure 3:
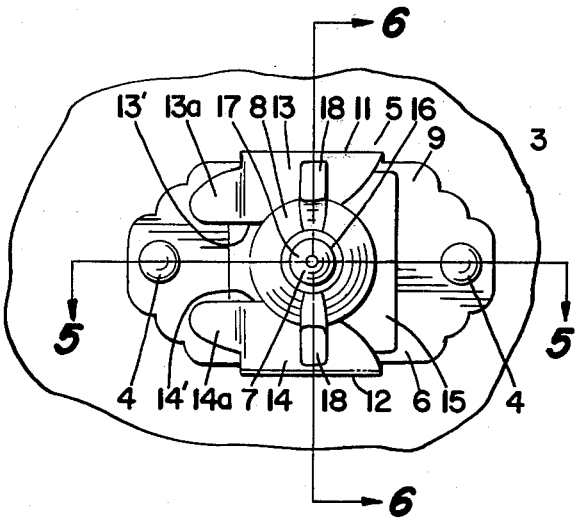
FIG. 3 is a plan view, at full-size scale, of a portion of the bottom of the bag of FIG. 2, showing a preferred form of the ground-penetrating member.

The flanges 13 and 14 are coplanar, and the inner edges of these flanges, designated respectively by reference numerals 13' and 14', are spaced from each other, as best seen in FIGS. 3 and 6, so that the flanges 13 and 14 have a limited degree of resiliency or flexibility in relation to the base plate 9, while providing a passageway therebetween for receiving a portion of the peg or pin 7 to be presently described.

The flanges 13 and 14 terminate at one end thereof in inclined flanges 13*a* and 14*a* (see FIGS. 3, 4 and 5), which extend to substantially the base plate 9, and which serve a purpose to be presently explained.

The peg or pin 7 comprises a head 15 of uniform thickness, equivalent or substantially equivalent to the depth of the space between the base plate 9 and the flanges 13 and 14, and of square or substantially square contour, each side of which is of a length somewhat less than the distance between the flanges 11 and 12.

The head 15 of the peg or pin 7 has formed integrally therewith a shank comprising a threaded portion 16, of uniform diameter, and a spike or tapered portion 17.

Figure 4:
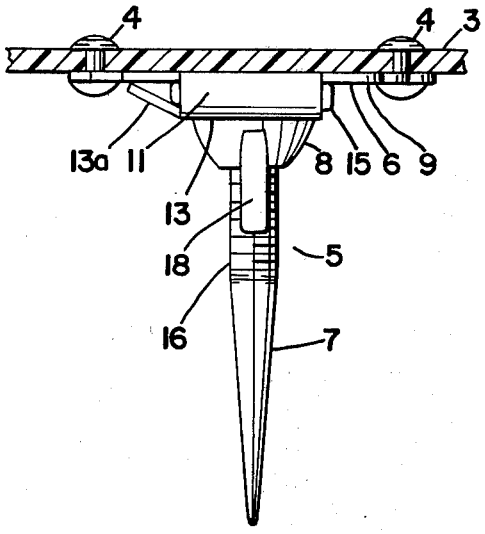
FIG. 4 is a side elevational view of the ground-penetrating member of FIG. 3.

The wing nut 8 is threadedly secured to the threaded portion 16 of the peg or pin 7, and is provided with wings 18 (FIGS. 3, 4 and 6).

The base plate 9 of each of the holder elements 6 is permanently secured to the bottoms 3 of the bag, as by means of rivets 4, which extend through the holes 10 of the base plate, in the manner shown in FIG. 5.

For the purpose of preventing the pegs or pins 7 from damaging the interior of the car, while the golf bags are in the car or the trunk thereof, the pegs or pins 7, with the wing nuts 8 mounted thereon, are carried separately in a compartment of the golf bag or in the glove compartment of the car.

When the golf bag is to be used, the heads 15 of the pegs or pins 7 are inserted into the space between the base plate 9 and flanges 13 and 14 of the holder elements 6, and to a position such that the shanks 16 of the pegs or pins are aligned axially with the centers of the base plates 9. During this alignment of the pegs or pins 7, the wing nuts 8 are withdrawn slightly from the flanges 13 and 14, so as not to interfere with passage of the heads 15 into the space between the base plate 9 and flanges 13 and 14, or passage of the shanks 16 through the space between the edges 13' and 14' of the flanges 13 and 14. To insure that the pegs or pins 7 have been properly placed or positioned, the flanges 13*a* and 14*a* constitute stops to prevent the heads 15 of the pegs or pins from moving beyond such position.

After the pegs or pins have been properly placed, the wing nuts 8 are tightened, in order to firmly grip the heads 15 of the pegs or pins 7 between the base plate 9 and the flanges 13 and 14 of the holder elements 6.

With the pegs or pins 7 thus firmly secured to the holder elements 6, the golfer, when he is about to select a club from the bag, holds the bag in an upright position, and pushes downwardly on the bag with sufficient pressure to cause the pegs or pins to penetrate into the ground, in the manner shown in FIG. 1. This holds the bag in such upright position, enabling the golfer to use both hands, if necessary, to remove a club from the bag. After the club has been replaced, the golfer can easily lift the bag from the ground, and carry the bag to a position for the next stroke.

After the game has been completed, the golfer may loosen the wing nuts, and then slide the pegs or pins out of the holder elements.

Figure 7:
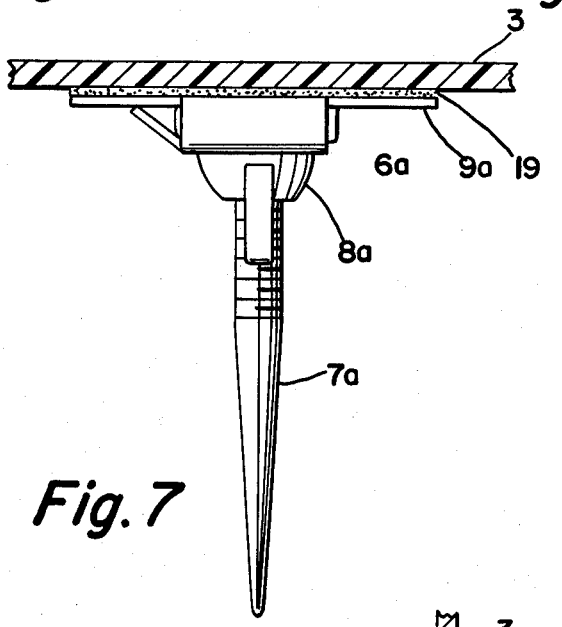
FIG. 7 is a view similar to FIG. 4, but of a modified form of ground-penetrating member.

In that form of the invention shown in FIG. 7, the holder elements 6*a*, pegs or pins 7*a*, and wing nuts 8*a* are identical in construction with those shown in FIGS. 1 to 6 inclusive, but in this case, the base plates 9*a* of the holder elements 6*a* are not provided with holes for the reception of rivets for securing the base plates to the bottom 3 of the bag.

Instead, the base plates 9*a* are cemented or adhesively secured to the bottom 3 of the bag, as by a layer 19 of cement or adhesive.

The modification of FIG. 7 is useful in those cases where the manufacturer does not secure the holder elements to the bottom of the bag in the course of manufacture of the bag.

In other words, if a golfer should purchase or own a conventional golf bag which does not have the ground-penetrating or engaging members already secured to the bottom of the bag, he may purchase the parts 6*a*, 7*a* and 8*a*, as separate units or accessories, and cement the parts 6*a* to the bottom of the bag.

Figure 8:
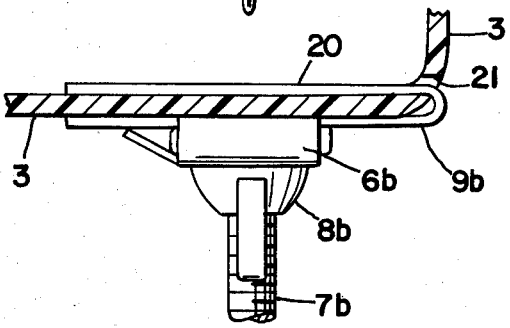
FIG. 8 is a view similar to FIG. 7, but of another modified form of ground-penetrating member.

In that form of the invention shown in FIG. 8, the holder elements 6*b*, pegs or pins 7*b*, and wing nuts 8*b* are identical or substantially identical with those shown in FIG. 7, but in this case, the base plate 9*b* is provided with a rebent flange 20, which is parallel with the base plate 9*b*, and is spaced from the plate 9*b* a distance slightly less than the thickness of the bottom 3 of the bag.

The bottom 3 of the bag is provided, adjacent its peripheral edge, with slots 21, whereby, when it is desired to attach the base plate 9*b* to the bottom of the bag, the flange 20 is inserted through the slot 21, and pushed to the position shown in FIG. 8, thereby causing the flange 20 to be firmly clamped to the bottom of the bag.

It is to be understood that the forms of my invention, herewith shown and described, are to be taken as preferred examples of the same, and that various changes may be made in the shape, size and arrangement of parts thereof, without departing from the spirit of the invention or the scope of the subjoined claims.

Having thus described my invention, I claim:

1. In combination with a golf bag having a bottom, an attachment for enabling the bag to be supported on the ground during selection of a club therefrom, said attachment comprising a holder element secured to the bottom of the bag, and a ground-penetrating element having a head secured to said holder element, said holder element comprising a base plate having depending spaced flanges terminating in inturned flanges which are disposed in a plane parallel with and spaced from said base plate and are spaced from each other, and said ground-penetrating element comprising a head insertable in the space between said base plate and inturned flanges, and a shank extending from said head and downwardly through the space between said inturned flanges, and terminating in a spiked portion.

2. The combination, as defined in claim 1, wherein said inturned flanges are provided at one end with upturned flanges adapted to be abutted by said head, whereby to properly position the ground-penetrating element in relation to said base plate.

3. The combination, as defined in claim 2, including a wing nut threadedly secured to said shank, and adapted to be moved toward said base plate, to engage said inturned flanges and clamp said head to said base plate.

4. An attachment for a golf bag having a bottom, said attachment comprising a holder element having a base plate and having depending spaced flanges terminating in inturned flanges which are disposed in a plane parallel with said base plate and are spaced from each other, and a ground-penetrating element having a substantially broad flat head disposed in the space between said base plate and said inturned flanges and a shank formed integrally with said head and extending from said head and downwardly through the space between said inturned flanges, and terminating in a spiked portion.

5. An attachment for a golf bag, comprising a holder element, and a ground-penetrating element having a head secured within said holder element, said holder element comprising a base plate having depending spaced flanges terminating in inturned flanges which are disposed in a plane parallel with and spaced from said base plate and are spaced from each other, and said ground-penetrating element comprising a head insertable in the space between said base plate and inturned flanges, and a shank extending from said head and downwardly through the space between said inturned flanges, and terminating in a spiked portion.

6. An attachment, as defined in claim 5, wherein said inturned flanges are provided at one end with upturned flanges adapted to be abutted by said head, whereby to properly position the ground-penetrating element in relation to said base plate.

7. An attachment, as defined in claim 6, including a wing nut threadedly secured to said shank, and adapted to be moved toward said base plate, to engage said inturned flanges and clamp said head to said base plate.

8. In combination with a golf bag having a bottom provided adjacent its periphery with a slit, an attachment for enabling the bag to be supported on the ground in an upright position during selection of a club therefrom, said attachment comprising a holder element provided with a flange adapted to be inserted through said slit for the purpose of removably securing the holder element to the bottom of the bag, said holder element having spaced inturned flanges in spaced relation to the bottom of the bag, and a ground-penetrating element having a substantially broad flat head disposed in the space between the bottom of the bag and said inturned flanges and a shank formed integrally with said head and extending from said head and downwardly through the space between said inturned flanges, and terminating in a spiked portion.

* * * * *